US012140397B2

(12) United States Patent
Tseng

(10) Patent No.: US 12,140,397 B2
(45) Date of Patent: Nov. 12, 2024

(54) NON-LETHAL PROJECTILE THROWING DEVICE

(71) Applicant: Jui-Fu Tseng, Yilan (TW)

(72) Inventor: Jui-Fu Tseng, Yilan (TW)

(73) Assignee: Worlite Industry Co., Ltd., New Taipei (TW)

( * ) Notice: Subject to any disclaimer, the term of this patent is extended or adjusted under 35 U.S.C. 154(b) by 0 days.

(21) Appl. No.: 18/223,041

(22) Filed: Jul. 18, 2023

(65) Prior Publication Data

US 2023/0358503 A1 Nov. 9, 2023

(51) Int. Cl.
*F41B 11/72* (2013.01)

(52) U.S. Cl.
CPC ..... *F41B 11/72* (2013.01)

(58) Field of Classification Search
CPC ..... F41B 11/72; F41B 11/723
USPC ..... 124/72, 76; 102/346, 502
See application file for complete search history.

(56) References Cited

U.S. PATENT DOCUMENTS 3,733,727 A * 5/1973 Jones ..... F42B 5/045 42/76.01
3,820,462 A * 6/1974 Jackson, Jr. ..... F41A 19/40 42/1.15
3,889,652 A * 6/1975 Curtis ..... F41B 11/73 124/41.1
6,959,703 B1 * 11/2005 Spurlock ..... F41B 11/724 137/86
7,930,977 B2 * 4/2011 Klein ..... F42B 7/08 102/447
2005/0257783 A1 * 11/2005 Tippmann, Jr. ..... F41B 11/723 124/73
2015/0013656 A1 * 1/2015 Priestley ..... F41B 11/723 124/76
2019/0301843 A1 * 10/2019 Hammond ..... F42B 8/00

* cited by examiner

*Primary Examiner* — Bret Hayes

(57) ABSTRACT

A throwing device includes a case assembly including a cylindrical casing; a front cap including a first through hole and a first membrane; a cylindrical member urging against the first membrane and including an axial channel; a tapered moveable element in the casing; and a projectile in the casing; and a valve including a housing filled with pressurized air; a second membrane urging against the externally threaded rear extension; a joining member urging against the moveable element and including a second through hole; a moveable member; a cup shaped member blocking the second through hole and secured to the moveable member; an internally threaded limit member secured to the moveable member; a biasing member disposed on the moveable member; and a base secured to the housing and including a third through hole. The second membrane blocks the third through hole.

2 Claims, 6 Drawing Sheets

NON-LETHAL PROJECTILE THROWING DEVICE

BACKGROUND OF THE INVENTION

1. Field of the Invention

The invention relates to non-lethal projectile throwing devices and more particularly to a device capable of throwing one of a number of non-lethal projectiles using pressurized air.

2. Description of Related Art

An Air gun is a gun that fires projectiles using energy from compressed air or other gases that are mechanically pressurized. However, its components are complicated and in turn the air guns are prone to malfunction. Further, one kind of air gun can only fire one kind of projectile, i.e., only plastic pellets, paintballs, or p paprika paste. Therefore, an individual has to buy three different kinds of air guns or the like if the individual wants to fire the above three kinds of projectile. This may cost a lot.

Thus, the need for improvement still exists.

SUMMARY OF THE INVENTION

It is therefore one object of the invention to provide a throwing device, comprising a valve comprising a cylindrical housing filled with pressurized air and including an externally threaded rear extension, an annular recess in a rear end of the externally threaded rear extension, a second sealing ring disposed in the annular recess, a disc-shaped second membrane urging against the second sealing ring and the rear end of the externally threaded rear extension, a bare surface on a front end of an inner surface of the cylindrical housing, an internally threaded section adjacent to a rear end of the bare surface, and a second internal shoulder in a rear portion of the cylindrical housing; a joining member urging against a rear end of the moveable element and including a second through hole, a rear externally threaded extension secured to the internally threaded section, a rear annular groove in front of the rear externally threaded extension, a front annular groove secured to a rear end of the cylindrical casing, and a third sealing ring disposed in the rear annular groove and pressed by the bare surface; a cylindrical moveable member including a front hole and an externally threaded rear portion; a cup shaped member blocking the second through hole and including a transverse hole and a pin inserted through the transverse hole and the front hole to fasten the cup shaped member and the cylindrical moveable member together; an internally threaded limit member secured to the externally threaded rear portion and moveably disposed in the externally threaded rear extension; a conic biasing member having a front end urging against the cup shaped member and a rear end urging against the second internal shoulder; and an internally threaded cylindrical base secured to the externally threaded rear extension and including a third through hole aligned with the cylindrical moveable member; wherein the disc-shaped second membrane is disposed in a bottom of the internally threaded cylindrical base and blocks the third through hole.

The above and other objects, features and advantages of the invention will become apparent from the following detailed description taken with the accompanying drawings.

DETAILED DESCRIPTION OF THE INVENTION

Figure 1:
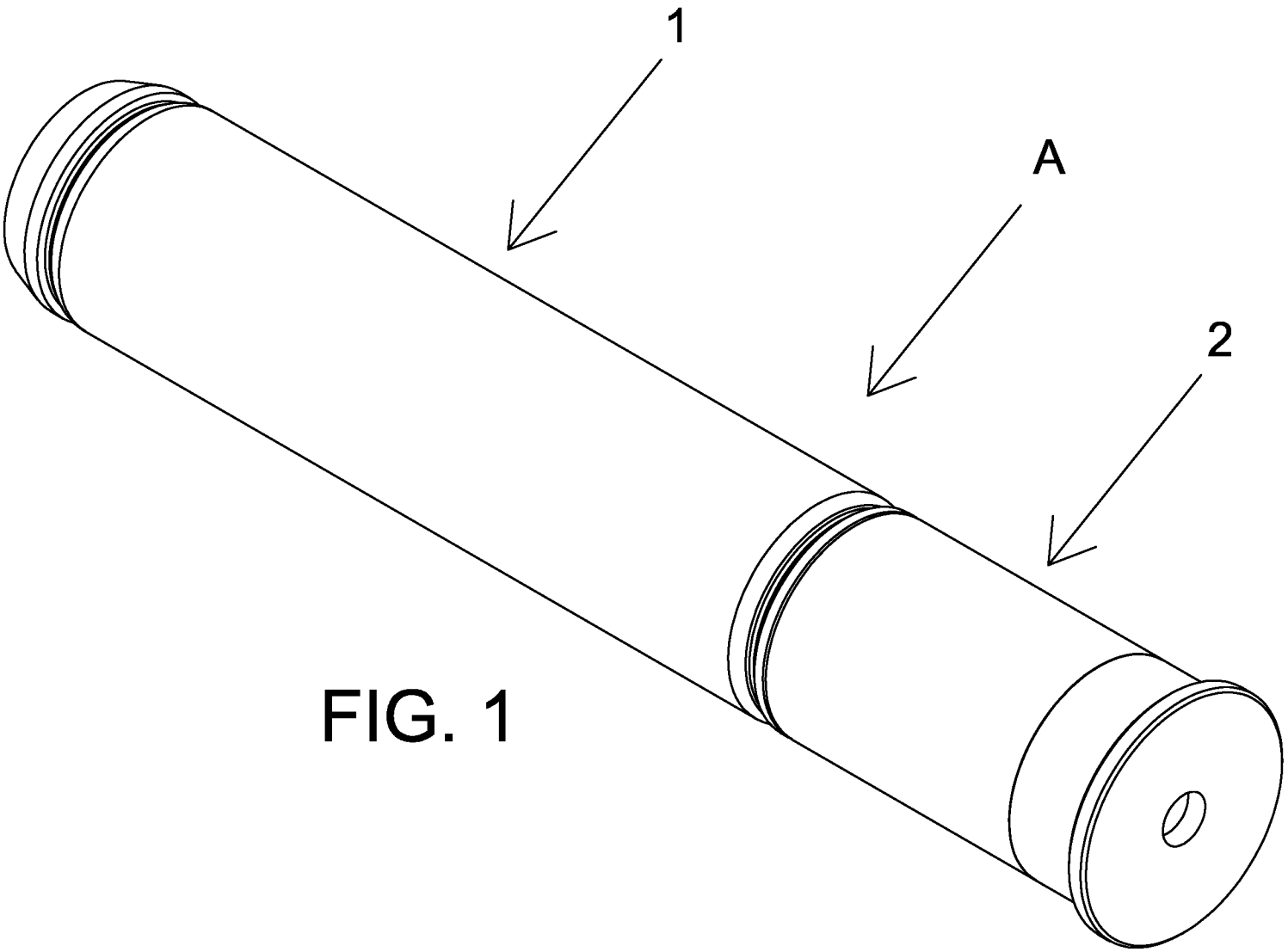
FIG. 1 is a perspective view of a non-lethal projectile throwing device according to the invention.
Figure 2:
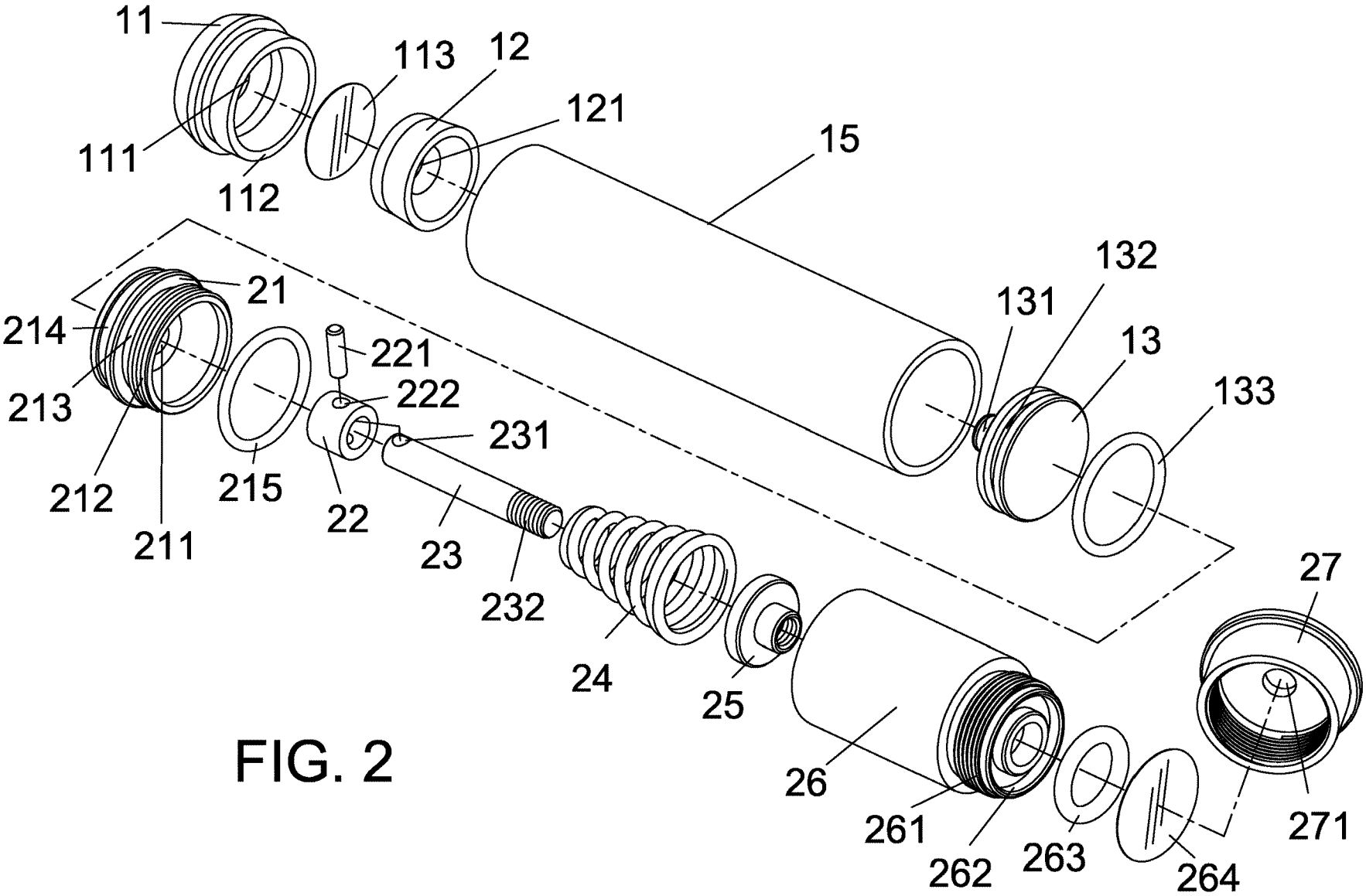
FIG. 2 is an exploded view of the non-lethal projectile throwing device.
Figure 3:
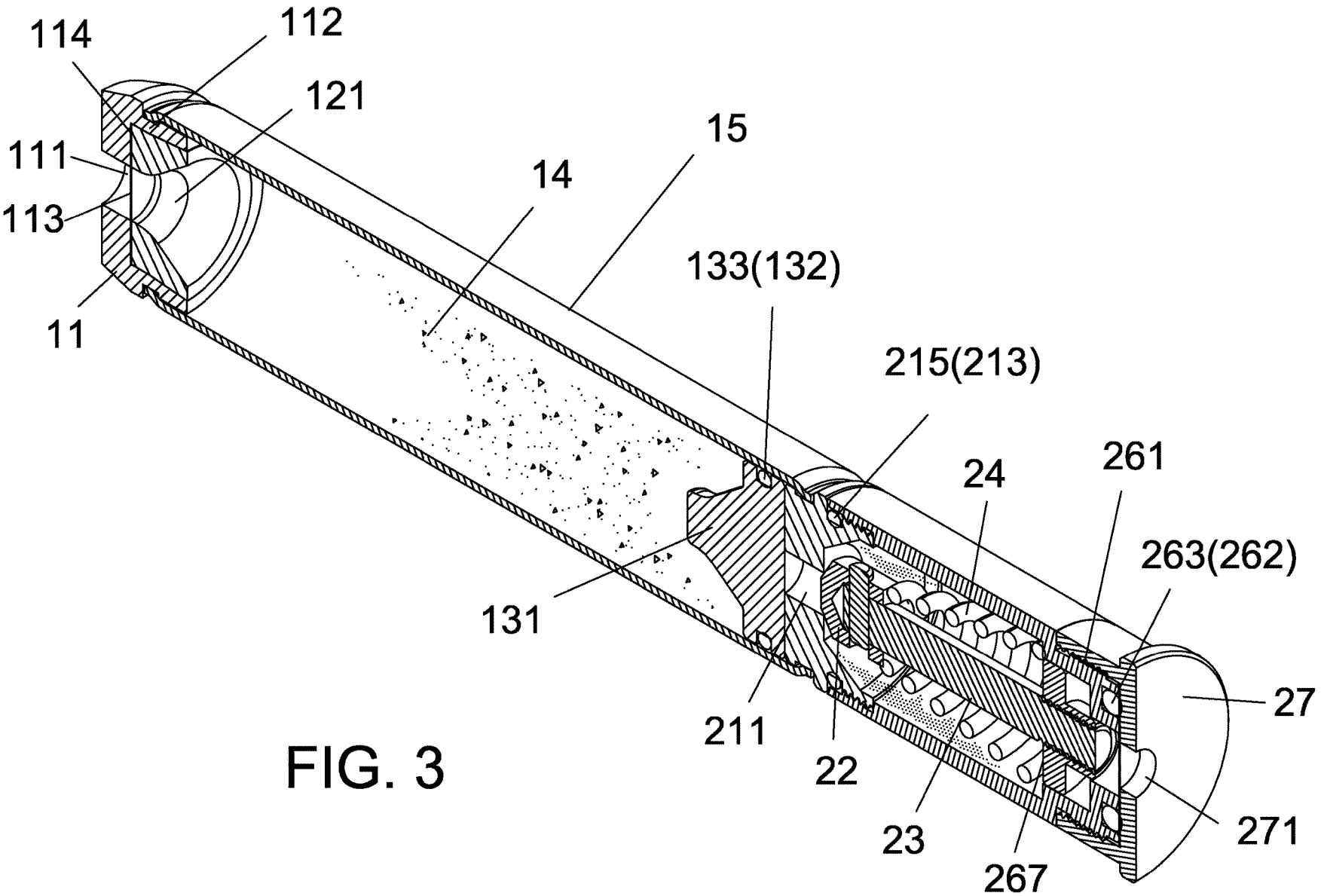
FIG. 3 is a longitudinal sectional view of the non-lethal projectile throwing device.
Figure 4:
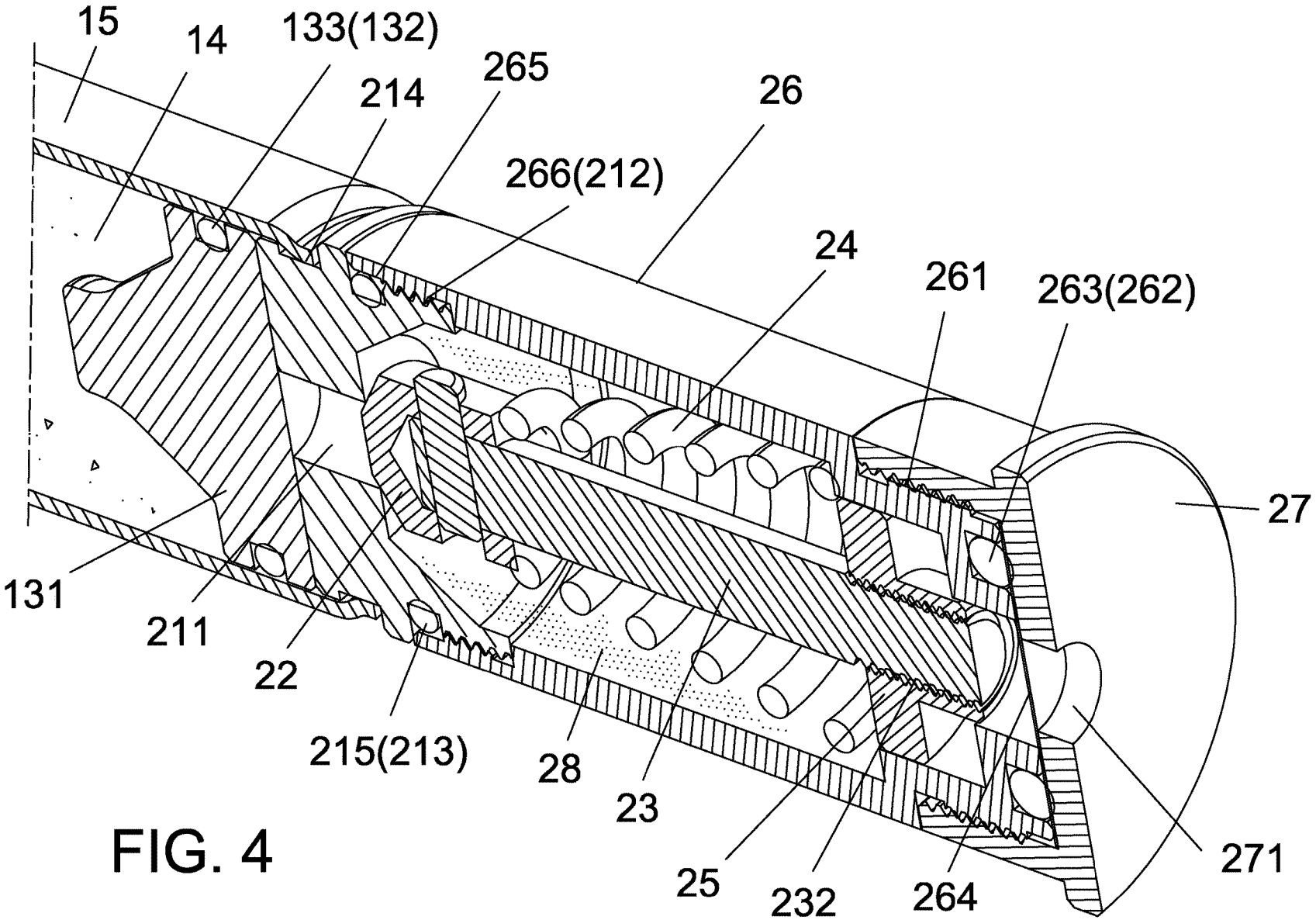
FIG. 4 is an enlarged view of the valve and a rear portion of the case assembly in FIG. 3.

Referring to FIGS. 1 to 6, a non-lethal projectile throwing device A in accordance with the invention comprises a case assembly 1 and a valve 2 as discussed in detail below.

The case assembly 1 comprises a cylindrical casing 15; a front cap 11 including a through hole 111, an internal shoulder 114, a stepped-diameter rear flange 112 secured to the cylindrical casing 15, and a disc-shaped membrane 113 urging against the internal shoulder 114 of the cap 11; a cylindrical member 12 disposed in a rear portion of the cap 11 and urging against the disc-shaped membrane 113, the cylindrical member 12 including an axial channel 121 aligned with the through hole 111; a moveable element 13 disposed in a rear portion of the cylindrical casing 15 and including a forward projection 131, a rear annular trough 132, a sealing ring 133 disposed in the rear annular trough 132; and a projectile 14 stored in the cylindrical casing 15 between the moveable element 13 and the disc-shaped membrane 113. The projectile 14 can be paprika paste, plastic pellets (BBs), paintballs, or net.

The valve 2 comprises a cylindrical housing 26 filled with pressurized air 28 and including an externally threaded rear extension 261, an annular recess 262 in a rear end of the externally threaded rear extension 261, a sealing ring 263 disposed in the annular recess 262, a disc-shaped membrane 264 urging against the sealing ring 263 and the rear end of the externally threaded rear extension 261, a bare surface 265 on a front end of an inner surface of the cylindrical housing 26, an internally threaded section 266 adjacent to a rear end of the bare surface 265, and a rear internal shoulder 267; a joining member 21 urging against a rear end of the moveable element 13 and including a through hole 211, a rear externally threaded extension 212 secured to the internally threaded section 266, a rear annular groove 213 in front of the rear externally threaded extension 212, a front annular groove 214 secured to a rear end of the cylindrical casing 15, and a sealing ring 215 disposed in the rear annular groove 213 and pressed by the bare surface 265; a cylindrical moveable member 23 including a front hole 231 and an externally threaded rear portion 232; a cup shaped member 22 blocking the through hole 211 and including a transverse hole 222 and a pin 221 inserted through the transverse hole 222 and the front hole 231 to fasten the cup shaped member 22 and the cylindrical moveable member 23 together; an internally threaded limit member 25 secured to the externally threaded rear portion 232 and moveably disposed in the externally threaded rear extension 261; a conic torsion spring 24 disposed on the cylindrical moveable member 23 and having a small front end urging against the cup shaped member 22 and a large rear end urging against the rear internal shoulder 267; and an internally threaded cylindrical base 27 secured to the externally threaded rear extension 261 and including a through hole 271 aligned with the cylindrical moveable member 23. The disc-shaped membrane 264 is disposed in a bottom of the internally threaded cylindrical base 27 and blocks the through hole 271.

Figure 5:
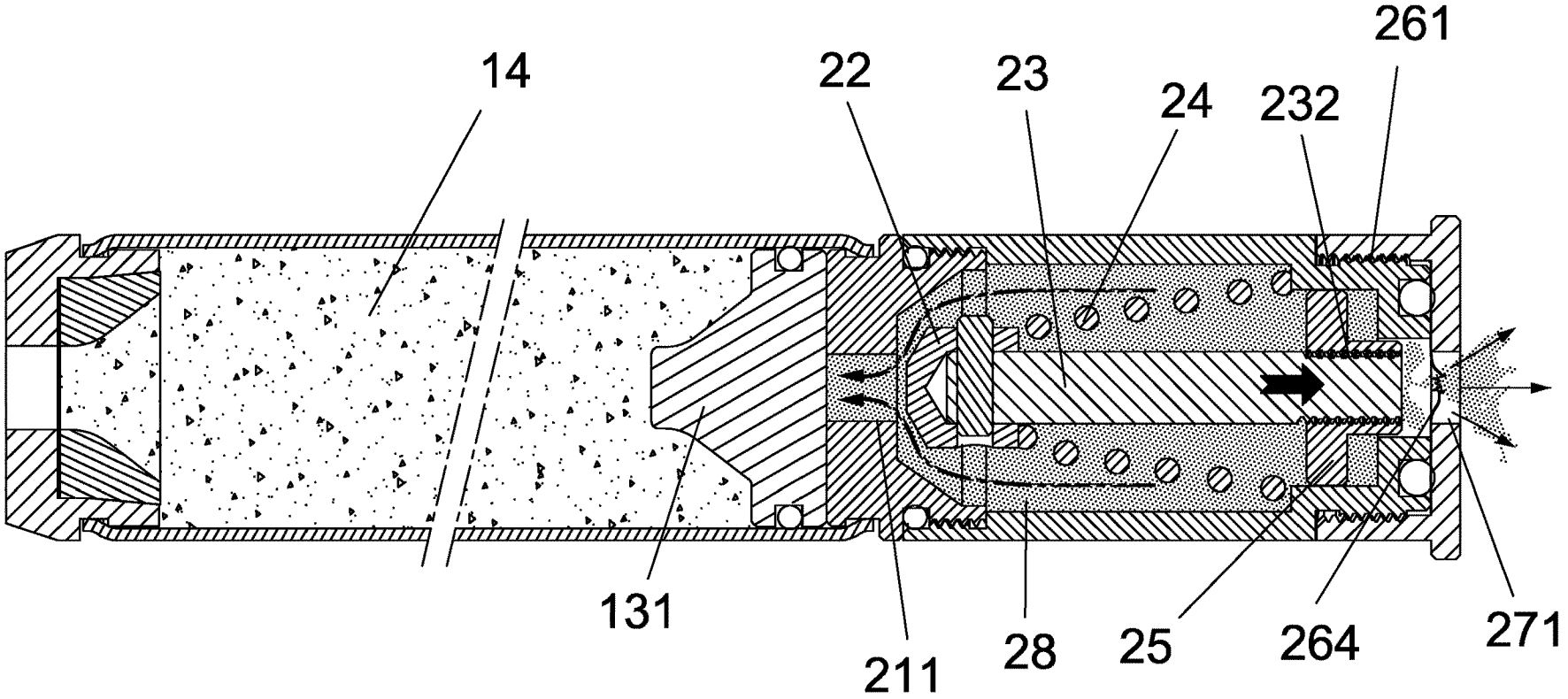
FIG. 5 is a longitudinal sectional view of the non-lethal projectile throwing device showing an initial stage of a firing.
Figure 6:
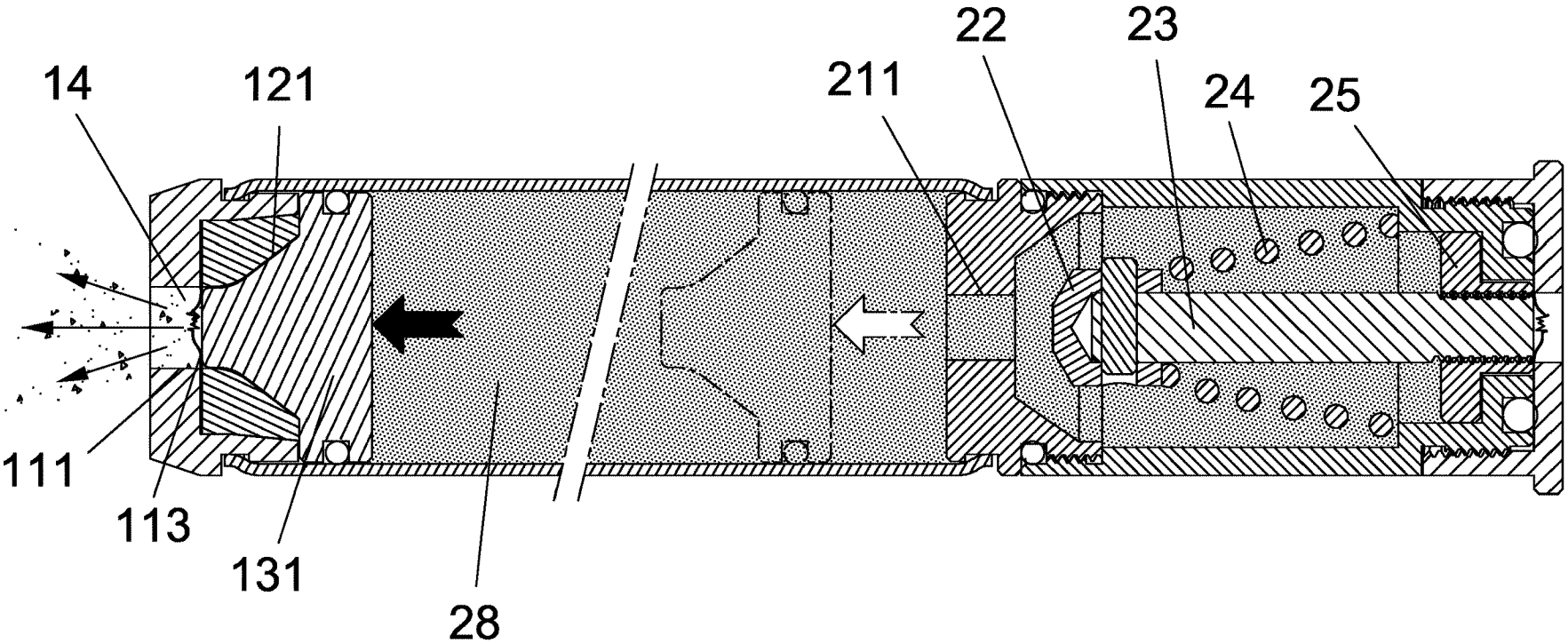
FIG. 6 is a longitudinal sectional view of the non-lethal projectile throwing device showing a final stage of the firing.

As shown in FIGS. 5 and 6 specifically, firing of the non-lethal projectile throwing device A is detailed below. A firing pin or the like strikes through the through hole 2711 to break the membrane 264. The moveable member 23 moves rearward because pressure in front of the membrane 264 is greater than that in the through hole 271. Thus, the cup shaped member 22 disengages from the through hole 211 to compress the torsion spring 24. Pressurized air 28 in the cylindrical housing 26 flows through the through hole 211 (as indicated by arrows) to move the moveable element 13 forward until the forward projection 131 is stopped by the axial channel 121. At the same time, the projectile 14 moves forward to break the membrane 113. Finally, the projectile 14 projects out of the through hole 111.

While the invention has been described in terms of preferred embodiments, those skilled in the art will recognize that the invention can be practiced with modifications within the spirit and scope of the appended claims.

What is claimed is:

1. A throwing device comprising:

a valve comprising a cylindrical housing filled with pressurized air and including an externally threaded rear extension, an annular recess in a rear end of the externally threaded rear extension, a first sealing ring disposed in the annular recess, a disc-shaped first membrane urging against the first sealing ring and the rear end of the externally threaded rear extension, a bare surface on a front end of an inner surface of the cylindrical housing, an internally threaded section adjacent to a rear end of the bare surface, and a first internal shoulder in a rear portion of the cylindrical housing;

a joining member including a first through hole, a rear externally threaded extension secured to the internally threaded section, a rear annular groove in front of the rear externally threaded extension, and a second sealing ring disposed in the rear annular groove and pressed by the bare surface;

a cylindrical moveable member including a front hole and an externally threaded rear portion;

a cup shaped member blocking the first through hole and including a transverse hole and a pin inserted through the transverse hole and the front hole to fasten the cup shaped member and the cylindrical moveable member together;

an internally threaded limit member secured to the externally threaded rear portion and moveably disposed in the externally threaded rear extension;

a conic biasing member disposed on the cylindrical moveable member and having a front end urging against the cup shaped member and a rear end urging against the first internal shoulder; and, an internally threaded cylindrical base secured to the externally threaded rear extension and including a second through hole aligned with the cylindrical moveable member;

wherein the disc-shaped first membrane is disposed in a bottom of the internally threaded cylindrical base and blocks the second through hole.

2. The throwing device of claim 1, further comprising:

a case assembly comprising a cylindrical casing;

a front cap including a third through hole, a second internal shoulder, a stepped-diameter rear flange secured to the cylindrical casing, and a disc-shaped second membrane urging against the second internal shoulder;

a cylindrical member disposed in a rear portion of the cap and urging against the disc-shaped second membrane, the cylindrical member including an axial channel aligned with the third through hole;

a moveable element disposed in a rear portion of the cylindrical casing and including a forward projection, a rear annular trough, a first sealing ring disposed in the rear annular trough; and, a projectile stored in the cylindrical casing between the moveable element and the disc-shaped second membrane; and wherein the joining member urges against a rear end of the moveable element and further comprises a front annular groove secured to a rear end of the cylindrical casing.

* * * * *